United States Patent [19]

Giflo

[11] 4,279,647

[45] Jul. 21, 1981

[54] CONSTRUCTION STEEL EXHIBITING HIGH FATIGUE STRENGTH

[76] Inventor: Henrik Giflo, III Ujitok u., 3532 Miskolc, Hungary

[21] Appl. No.: 49,867

[22] Filed: Jun. 18, 1979

[51] Int. Cl.[3] ..... C22C 38/06

[52] U.S. Cl. ..... 75/124; 75/125

[58] Field of Search ..... 75/124 E, 125

[56] References Cited

U.S. PATENT DOCUMENTS

| | | | |
|---|---|---|---|
| 3,809,550 | 5/1974 | Giflo et al. | 75/124 |
| 3,926,621 | 12/1975 | Asada et al. | 75/124 |
| 4,043,807 | 8/1977 | Kirman | 75/125 |

FOREIGN PATENT DOCUMENTS

| | | | |
|---|---|---|---|
| 1418471 | 10/1965 | France | 75/124 |
| 2245775 | 4/1975 | France | 75/124 |
| 1128527 | 9/1968 | United Kingdom | 75/124 |
| 570657 | 9/1977 | U.S.S.R. | 75/124 |

*Primary Examiner*—M. J. Andrews

*Attorney, Agent, or Firm*—Beveridge, DeGrandi, Kline & Lunsford

[57] ABSTRACT

Construction steel exhibiting a high fatigue strength.

The invention relates to construction steels. These steels are essentially characterized by the fact that they comprise, besides iron, at a maximum 1.6% (by weight) of C, 0.3 to 3% (by weight) of Mn and/or Ni, at a maximum 1.8% (by weight) of Si, 0.6 to 4% (by weight) of Cu, at a maximum 3% (by weight) of Mo and/ or Co, 0.02 to 0.4% (by weight) of Nb and/or V, at a maximum 0.006% (by weight) of B, at a maximum 0.4% (by weight) of Z and/or Be, 0.2% (by weight) of Al, 0.005 to 0.2% (by weight) of N, at a minimum 0.0005% (by weight) of Ca, and at a maximum 0.25% (by weight) of Ce and/or Pb, and up to 0.1% sulfur.

These steels exhibit a high fatigue strength and, up to a well defined carbon content (0.3%), a good weldability and are resistant to corrosion in the air.

3 Claims, No Drawings

CONSTRUCTION STEEL EXHIBITING HIGH FATIGUE STRENGTH

This invention relates to a construction steel exhibiting a high fatigue strength and, up to a well defined carbon content, a good weldability, and which is resistant to corrosion by air, this steel being particularly intended for making constructions and ossatures, earth or hydraulic works, vehicles, machines and machine elements, infrastructures and superstructures for railroads, etc., that are exposed to great cyclic stresses and the weather.

The present economic situation, which makes it particularly necessary to achieve a general reduction of consumption of energy and materials, causes all of industry, particularly in the fields of construction in the search for and production of hydrocarbons and transportation, to have to meet technical and economic requirements that the properties of standard steels can no longer satisfy, which, in a certain senses, puts a brake on the development of these sectors.

A profitable development of methods of construction and production and of standard technologies, and the application of new technical and technological solutions, and even the tapping of underground products that have not been utilized so far for technical and economic reasons, are unthinkable if a new grade of steel is not available exhibiting sufficient fatigue strength and complex properties favorable to an industrial transformation, this grade of steel having to be produced in a large amount and at sufficiently low cost to be able to be widely used.

Therefore, it was essential to develop a new grade of steel that, meeting these principles of saving energy and materials, could support present stresses, the cross section of the construction, and therefore its own weight, being clearly less, while offering a greater reliability, and which is even able to meet more demanding parameters, and recover the expenses thus incurred, the cost of industrial development and the transformation of this steel further being required not to exceed the specific costs incurred for making products fabricated with standard steels.

Construction steels are already known that exhibit good mechanical properties and good weldability when conditions are right.

In the field of weldable steels there can be listed, for example, the following grades of steel: T 1, RQC-100 A, HY and NAXTRA from the U.S.A., or HT, HW, KLN and RIVER-ACE from Japan. The chemical composition of these steels is characterized by the following contents: 0.10 to 0.23% (by weight) of C, 0.50 to 1.50% (by weight) of Mn, 0.60 to 1.50% (by weight) of Cr, and 1.0 to 9.5% (by weight) of Ni, and some grades further contain 0.50 to 1.00% (by weight) of Mo, 0.08 to 0.15% (by weight) of V, 0.003 to 0.04% (by weight) of B and 0.5 to 0.7% (by weight) of Cu.

It is characteristic of the mechanical properties of these steels that their apparent elastic limit—figured for an elongation of 0.2%—is between 500 and 700 N/mm$^2$, and that their plasticity lends itself to industrial transformation. The fatigue strength limit, in the case of a break occuring after $10^5$ stresses, is, for a stress $R=-1$, between 200 and 400 N/mm$^2$ and, for a stress $R=0$, between 250 and 500 N/mm$^2$ (on unwelded test pieces).

Some grade of steel exhibit a certain resistance to corrosion by air. The drawback of these steels, however, is that it is possible to give them good resistance characteristics only by a hardening and tempering treatment applied in special installations. Their mechanical properties are therefore the result of hardening and tempering, which limits the number of shapes that can be made with this quality, further gives rise to a great instability of these mechanical properties because of the lack of homogeneity of the hardening, and further ends, because of the limited passage capacity of the installation, the complexity of the latter and the high costs incurred, in a fabrication cost that amounts to several times the cost of normal working of steel.

The state of the material that has undergone a hardening and tempering treatment constitutes an additional difficulty for industrial transformation, particularly during hot sectioning or cutting, making of welded joints and hot bending.

The use of steels that have undergone hardening and tempering treatment is therefore greatly limited, despite their favorable mechanical properties, because of the absence of essential shapes, lack of homogeneity of the mechanical properties, the difficulties linked to their transformation and their high price. In the field of unweldable materials, steels are also know that have excellent mechanical properties, such as, for example, grade En and AISI-V developed in the United States, or grade GhNW from the Soviet Union, grades Rex, Melt-A and HST from Great Britain, or CSV4 and MOG from the Federal Republic of Germany. Their chemical composition is characterized by the following contents: 0.2 to 0.6% (by weight) of C, 0.2 to 1.6% (by weight) of Si, 0.3 to 1.6% (by weight) of Mn, 0.3 to 5.0% (by weight) of Mo and 0.1 to 1.0% (by weight) of V, but some grades also contain 1.5 to 3.0% (by weight) of W and 0.1 to 0.3% (by weight) of Ti.

It is characteristic of the mechanical properties of these steels that their apparent elastic limit, for a 0.2% elongation, is between 1300 and 1600 N/mm$^2$ when they are subjected to a hardening and tempering treatment, and that their ultimate tensile strength is between 1700 and 2000 N/mm$^2$, to which correspond an elongation of 7 to 10% and an impact strength between 0.7 and 2 daJ/cm$^2$, on an unnotched Izod test piece. For a stress $R=0$, figured on a number of cycles $10^4$ until breaking, their fatigue strength limit is between 400 and 800 N/mm$^2$.

The drawback of these steels is that their properties, mentioned above, show up only after a hardening and tempering treatment, which greatly limits their use because of the difficulties of transformation (hammer scales, casting scale, reticulation or warping, degree of machinability) and which further makes these steels rather fragile and sensitive to the notching effect, the cost of their working further excluding in practice a large-scale industrial application because of their high content of alloy elements.

Presently known construction steels therefore exhibit rather good mechanical properties, both in the weldable field and in the nonweldable field, because of the additions of alloy and heat treatments, i.e, hardening followed by tempering. But this method of increasing the resistance limits the variety of shapes that can thus be fabricated, the construction elements that have undergone a hardening treatment can in addition be machined, with difficulty, with the usual machines, and finally in the case of construction elements that have undergone a transformation before hardening, the high hardening temperature causes a decarburizing, a reticulation or a warping, and possibly, cracking. Working of these steels requires special equipment, which increases the expenses still more and does not permit large-scale industrial application. The combination of these drawbacks ends up in considerably reducing the useful value of these steels, despite their apparently favorable mechanical properties.

The present invention has for its object development of construction steels resistant to wear and corrosion by air, and exhibiting a good weldability up to certain limits of carbon content (0.3%), steels whose fatigue strength limit and apparent elastic limit are greater than those of standard steels and which can, thanks to their various reinforcement mechanisms and without hardening, serve as a base material for making constructions and ossatures, earth or hydraulic works, vehicles, machines and machine elements, that are exposed to great cyclic stresses and to the weather.

The present invention makes it possible to achieve the stated objective by the fact that the worked steel contains, besides iron and usual residual elements such as P, As, Se, etc . . . , at the maximum 1.6% (by weight) of C, 0.3 to 3.0% (by weight) of Mn and/or Ni, at the maximum 1.8% (by weight) of Si, 0.6 to 4.0% (by weight) of Cu, at the maximum 3.0% (by weight) of Mo and/or Co, 0.02 to 0.4% (by weight) of Nb and/or V, at the maximum 0.006% (by weight) of B, at the maximum 0.4% (by weight) of Zr and/or Be, 0.02 to 0.2% (by weight) of Al, 0.005 to 0.2% (by weight) of N, at the minimum 0.0001% (by weight) of Ca, and at the maximum 0.25% (by weight) of Ce and/or Pb, the sulfur can be present in certain cases up to 0.1%.

Compositions more particular preferred according to the invention comprise:

| | | | |
|---|---|---|---|
| C | 0.04–0.5% | Nb | 0.01–0.15% |
| Mn | 1.50–2% | V | 0.01–0.15% |
| Si | 0.5–1% | Zr | 0.01–0.15% |
| S | 0.01–0.05% | Al | 0.02–0.2% |
| Cu | 1.20–2% | N | 0.01–0.04% |
| Ni | 1–1.50% | B | 0.0001–0.005% |
| Mo | 0.05–0.5% | Ca | 0.0001–0.005% |
| | | Pb | 0.01–0.25% |

for weldable steels.

The preferred composition for nonweldable steels is the following:

| | | | |
|---|---|---|---|
| C | 0.04–0.5% | Nb | 0.01–0.15% |
| Mn | 1.50–2% | V | 0.05–0.15% |
| Si | 0.5–1% | Zr | 0.01–0.15% |
| S | 0.01–0.05% | Be | 0.01–0.05% |
| Cu | 1.5–2% | B | 0.0001–0.006% |
| Ni | 1–1.50% | Al | 0.01–0.2% |
| Mo | 0.05–1% | Ca | 0.0005–0.005% |
| | | Pb | 0.01–0.25% |

Some of the alloy elements when they are in the ratio according to the invention, form complex metal compounds which, in part, already produce, from the time of the pouring stage, active nuclei of critical dimension, and which are also, in part, put in solution in the interstices thus creating a prestress in the iron lattice and thus increasing the number of flaws of the lattice. Other alloy elements cause metal precipitations having a great shearing resistance, which increase and stabilize at the same time, in a coherent manner, the internal tension of the lattice of the base material.

The increase of the number of nuclei of critical dimension involves a great increase of the aptitude to crystallization which pouring exhibits, a reduction of the solidification time and the coarseness of the primary grain, a sudden increase in the surface of the boundaries of the grains and a limitation of the possible formation of intermetallic enrichments.

The advantageous properties and ratio of the components, in the alloy system according to the present invention, create such thermodynamic, kinetic and nucleus-forming conditions, while being put into solution, solidification, recrystallization and hot deformation that the arrangement of the components on being put into interstitial solution, the amount of these components and the number and degree of stress of the lattices thus put under pre-stress are clearly increased.

Thanks to the increase in the number of lattices exhibiting an interstitial pre-stress and their degree of stress, the number of dislocations produced metallurgically and which promotes and govern the formation, and the dispersion of metallic precipitations is greatly increased which notably increases the effectiveness of the anchoring function or fixing of precipitations during dislocation front movement that the precipitations trigger.

The components according to the present invention and their advantageous ratio thus automatically assure excellent metallurgical quality of the steel during its working and the positive effect of various present reinforcement mechanisms, whose combined and cumulated action increased the useful mechanical resistance and the fatigue strength limit of the steel.

The chemical composition of the steel according to the present invention also comprises alloy elements that are not put in solution in the iron and do not combine with it, but which are enriched on the surface of the steel. Consequently, there is formed, in the long run, on the surface, from the action of the atmosphere, a dense protective layer that is hard to dissolve and which protects the steel from the corrosive action of the environment and well determined fluids, by eliminating the possibility of corrosion by specks and by improving the fastness of the color of the steel.

The steel according to the invention exhibits a good weldability for a given carbon content and with a suitable addition of heat, and the properties of the thermally affected zone are identical with those of the base material.

Since working of the steel according to the present invention does not require a reducing atmosphere, it can be performed by standard installations, and it is possible, by hot shaping processes, to give the steel any dimensions and shapes, by rolling or stamping, mass production being able to be performed without any special installations.

The steel according to the present invention exhibits, without hardening, excellent mechanical properties, and at the same time allows application of standard transformation and assembly technologies.

In the field of nonweldable steel, it is possible to regulate, by tempering, the aptitude for transformation or machining, and also the hardness after machining, by a low-temperature heat treatment. The price of the steel according to the present invention thus is not saddled, as a base material, with the cost of a complicated hardening and tempering treatment performed in a special liquid, and by the cost of the installations required for this purpose, and, further, the fabrication costs of products made with the steel according to the present invention do not exceed the cost of standard products.

This is why the profit that can be obtained on the economic level from the technical advantages offered by the steel according to the present invention (reduction of energy consumption and weight, etc . . . ) thanks to the high limits of fatigue strength and elasticity, is practically unaffected by the costs of working and of using the new base material.

This invention will be better understood from the detailed description of various embodiments given as nonlimiting examples of working the steel and of its mechanical properties.

EXAMPLE 1

Three charges of steel according to this invention are shown, by way of example, in the field of weldable steels. The charges were made in a 60-ton arc furnace and then refined in metallurgical equipment comprising ladles. Pouring was performed in a continuous pouring installation with four dies having a shape of 240×240 mm, and then was produced by rolling, from billets, and under normal conditions, steel rods with a diameter of 20 mm which were then cooled in the air on coolers.

The results of an examination of the charges according to this invention are given below.

1.1 Chemical composition of the charges in percentages (weight)

TABLE I

| Charge | C | Mn | Si | P | S | Cu | Ni |
|---|---|---|---|---|---|---|---|
| 1 | 0.08 | 1.69 | 0.88 | 0.018 | 0.012 | 1.63 | 1.10 |
| 2 | 0.155 | 1.63 | 0.905 | 0.015 | 0.022 | 1.70 | 1.09 |
| 3 | 0.21 | 1.66 | 0.76 | 0.014 | 0.014 | 1.39 | 1.12 |

| Charge | Mo | Nb | V | Zr | Al | N |
|---|---|---|---|---|---|---|
| 1 | 0.10 | 0.030 | 0.04 | 0.04 | 0.15 | 0.0213 |
| 2 | 0.08 | 0.050 | 0.07 | 0.029 | 0.059 | 0.0248 |
| 3 | 0.12 | 0.051 | 0.05 | 0.027 | 0.027 | 0.0244 |

| Charge | B | Ca | Pb |
|---|---|---|---|
| 1 | 0.0024 | 0.0020 | 0.07 |
| 2 | 0.0025 | 0.0015 | 0.09 |
| 3 | 0.0022 | 0.0011 | 0.06 |

In the examples that follow the abbreviations have the following meaning:

Rp elastic limit
Rm breaking load
$A_5$ elongation
Z necking down
KCU impact strength 1.2 Mechanical properties

TABLE 2

| Designation | Rolled[1] | | | 500° C.[2] | | |
|---|---|---|---|---|---|---|
| Unit of measure | 1. | 2. | 3. | 1. | 2. | 3. |
| $R_p^{0.002}$ N/mm² | 800 | 790 | 800 | 855 | 860 | 920 |
| $R_m$ N/mm² | 970 | 1010 | 900 | 1050 | 1060 | 1090 |
| $A_5$ % | 18.5 | 19 | 18.5 | 18.2 | 18 | 17 |
| Z % | 49 | 50 | 50 | 49 | 46 | 41 |
| KCU: | | | | | | |
| da J/cm² + 20° C. | 20 | 22 | 21.4 | 18.7 | 19.4 | 20 |
| da J/cm² − 40° C. | 8 | 8.7 | 8 | 9 | 9.7 | 10.2 |

| Designation | 1250 C[3] | | |
|---|---|---|---|
| Unit of measure | 1. | 2. | 3. |
| $R_p^{0.002}$ N/mm² | 810 | 800 | 890 |
| Rm N/mm² | 1040 | 1030 | 1085 |
| $A_5$ % | 16.4 | 16 | 15 |
| Z % | 43 | 42 | 39 |
| KCU | | | |

TABLE 2-continued

| | | | |
|---|---|---|---|
| da J/cm² + 20° C. | 17.1 | 18 | 19.4 |
| da J/cm² − 40° C. | 8 | 7 | 7.3 |

[1]Rolled state without heat treatment
[2]kept hot, at 500° C., for 90 minutes, then air cooled
[3]kept hot at 1250° C., for 45 minutes, then air cooled 1.3 Weldability Samples were examined, welded in an inert atmosphere, of a plate 12 mm thick made with charge 2. The plate underwent no heat treatment either before or after welding.

Thickness of plate = V = 12 mm
Type of welding—counter welding (at an angle of 60°)
Addition of heat = 3000 joule/cm mm
Number of welds = 3 + 1
Inert atmosphere = $CO_2$
Welding wire = material itself, with a diameter of 1.6 mm 1.31 Tensile test $R_p^{0.002} = 784.7$ N/mm²
$R_m = 902.6$ N/mm²
$A_5 = 16\%$
$Z = 52\%$
Break occurring outside the weld.

1.32 Plasticity of the thermally affected zone

TABLE 3

| Notch of sample for impact test, measured from the straight edge of the unbeveled weld mm | Effect of impact at KCU - 40% da J/cm² |
|---|---|
| 0 | 7 |
| 1 | 8.4 |
| 2 | 10 |
| 3 | 9 |
| 4 | 8.7 |
| 5 | 8 |
| 7 | 10 |
| 10 | 9.7 |
| 15 | 10.5 |

1.4 Resistance to corrosion by air
(measured in the volume of air of an industrial building)

TABLE 4

| | Average depth of penetration of corrosion (mm) | | |
|---|---|---|---|
| | | Steel used for comparison | |
| Test period (years) | Charge 2 | Carbon steel | Steel containing 0.6% copper |
| 0.5 | 0.007 | 0.08 | 0.030 |
| 1 | 0.010 | 0.12 | 0.045 |
| 2.5 | 0.012 | 0.16 | 0.070 |

1.5 Fatigue strength

The fatigue or endurance test was made on a Schenk-Elringer type fatigue test machine, operating on the resonance principle. In this case, both the static prestress component and the oscillating load (±Fa) were applied by springs resting on a common load head, The static load was established and adjusted by a threaded shaft and the oscillating spring was energized by an electric motor. The oscillation or vibration energized by the rotation of the eccentric mass operated the pulsator at the resonance point, and said pulsator produced a static load between 0 and 20 megaponds and a cyclic load of ±10 mp.

A steel rod, with a diameter of 20 mm, made by rolling from charge 2, was subjected to the fatigue test. The results of the control tensile test, made on a rolled sample that had not received heat treatment, appear in Table 5.

TABLE 5

| Designation Unit of measure | Mechanical properties: Charge 2 without heat treatment | Treatment steel 420 D4 |
|---|---|---|
| $R_p^{0.002}$ N/mm$^2$ | 892.7 | 1079.1 |
| $R_m$ N/mm$^2$ | 983.9 | 1147.7 |
| $A_5$ % | 16.4 | 14.6 |
| Z % | 57 | 50.7 |
| KCU + 20° C. da J/cm$^2$ | 19.8 | 11.8 |

By way of comparison, the test was also run on steel grade 42CD4, using the same method and a similar sample. The chemical composition of the steel used as a base of comparison appears in Table 6, while the mechanical properties are indicated in Table 5.

TABLE 6

| Steel grade | Chemical composition in percentages (weight): C | Si | Mn | Cr | Mo | Ni | Ti |
|---|---|---|---|---|---|---|---|
| 42CD4 | 0.42 | 0.29 | 0.65 | 1.10 | 0.20 | 0.20 | 0.05 |

1.51 Degrees of load of fatigue test

TABLE 7

| Designation | Degrees of load (N): $42DC4_I$ | Ch 2 | $42CD4_{II}$ | Ch 2 | $42CD4_{III}$ | Ch 2 |
|---|---|---|---|---|---|---|
| F max | 68000 | 96000 | 68000 | 78000 | 68000 | 68000 |
| F min | 9000 | 9000 | 29000 | 9000 | 39000 | 9000 |
| Fa | 29000 | 44000 | 19000 | 34000 | 18000 | 29000 |

1.52 Stress corresponding to the degree or stages of load and to which the samples were subjected.

TABLE 8

| Designation | Stresses corresponding to loads N/cm$^2$: I. 42CD4 | CH 2 | II. 42CD4 | Ch 2 | III. 42CD4 | Ch 2 |
|---|---|---|---|---|---|---|
| F max | 27664 | 39534 | 27664 | 31588 | 27664 | 27664 |
| F min | 3953 | 3953 | 11870 | 3953 | 15794 | 13832 |
| Fa | 11870 | 17805 | 7906 | 14782 | 5935 | 11870 |

1.53 Fatigue test results

TABLE 9

In the case of steel 42CD4

| Degree of load | E lg Ni n | Probably 50% life |
|---|---|---|
| I. | 10.9985 | 59783 |
| II. | 12.1960 | 198000 |
| III. | 12,8229 | 370594 |

| | empirical dispersion square | life: 15% Breaking probability | 85% Breaking probability |
|---|---|---|---|
| I. | 0.04606 | 47258 | 75628 |
| II. | 0.17445 | 126692 | 309442 |
| III. | 0.06455 | 281653 | 487621 |

In the case of steel of charge 2

| Degree of load | E lg Ni n | Probably 50% life |
|---|---|---|
| I. | 11.4256 | 91638 |
| II. | 12.3315 | 226715 |
| III. | 13.4427 | 688732 |

TABLE 9-continued

| | empirical dispersion square | life: 15% Breaking probability | 85% Breaking probability |
|---|---|---|---|
| I. | 0.2795 | 52485 | 160000 |
| II. | 0.22673 | 131822 | 389917 |
| III. | 0.73595 | 278821 | 1701277 |

1.54 Interpretation of fatigue test results

By comparing the test results obtained with an identical stress of steel 42CD4 and the steel of charge 2 worked according to the present invention, it was found, for a 50% breaking probability, that 60,000 stresses corresponded to this value in the case of the steel used as a basis of comparison as against 700,000 stresses in the case of the steel according to the present invention. Comparison of the results obtained by identical test methods shows that with an identical load the life of the steel according to the present invention is almost equal to ten times that of the standard steel used as a basis of comparison.

By comparing the values of resistance or load of the period corresponding to 50% breaking probability, i.e., the straight lines that represent, in the same figure, the fatigue strength of the two materials, it can be seen that the steel according to the present invention supports loads that are almost double those supported by steel 42CD4.

TABLE 10

| Number of stresses Ni | Load Fa corresponding to a 50% breaking probability (N): 42CD4 | Charge 2 |
|---|---|---|
| $9 \times 10^5$ | 26000 | 44000 |
| $2 \times 10^6$ | 19000 | 38000 |
| $3 \times 10^6$ | 16000 | 35000 |
| $4 \times 10^6$ | 14000 | 32000 |
| $6 \times 10^6$ | 11000 | 29000 |
| $8 \times 10^6$ | 9000 | 26000 |

EXAMPLE 2

Two charges made up of the steel according to the present invention are shown, by way of example, in the field of nonweldable steels. The charges were produced in a 65-ton arc furnace, then refined in metallurgical equipment comprising ladles, and poured in a continuous pouring installation have a shape of 240×240 mm. Steel rods were then produced, by rolling, under normal conditions, from billets, and cooled on coolers. The diameter of these steel rods was 20 mm. The test results are shown below.

2.1 Chemical composition of charges

TABLE 11

Chemical composition in percentages (weight)

| | C | Mn | Si | P | S | Cu | Ni | Mo |
|---|---|---|---|---|---|---|---|---|
| 4 | 0.36 | 1.62 | 0.84 | 0.012 | 0.010 | 1.59 | 1.20 | 0.07 |
| 5 | 0.45 | 1.80 | 0.74 | 0.011 | 0.015 | 1.69 | 1.22 | 0.09 |

| | Nb | V | Zr | Be | B | Al | Ca | Pb |
|---|---|---|---|---|---|---|---|---|
| 4 | 0.07 | 0.07 | 0.03 | 0.0219 | 0.0050 | 0.03 | 0.0017 | 0.04 |
| 5 | 0.036 | 0.07 | 0.03 | 0.0201 | 0.0035 | 0.04 | 0.002 | 0.06 |

2.2 Mechanical properties

TABLE 12

| Designation | 450° C.[1] | | 650° C.[2] | | 850° C.[3] | |
|---|---|---|---|---|---|---|
| Unit of measure | 4 | 5 | 4 | 5 | 4 | 5 |
| $R_p^{0.002}$ N/mm$^2$ | 1412 | 1569 | 931 | 1140 | 1716 | 1600 |
| $R_m$N/mm$^2$ | 1765 | 2060 | 1030 | 1210 | 1863 | 2100 |
| $A_5$ % | 10 | 8 | 17 | 16 | 10 | 10 |
| Z % | 20 | 20 | 45 | 48 | 15 | 18 |
| KCU −40° C. (da J/cm$^2$) | 2.5 | 2.2 | 3 | 4 | 2.9 | 2.7 |

2.3 Fatigue strength

The fatigue test was intended to examine the properties of the steel according to the present invention when it was subjected to an oscillation or vibration force varying with time. The test method used was, besides fatigue tests by cyclic torsions with samples of fatigue by torsion which are usual, the Locati method, intended to determine the resistance to the combined forces of bending and torsion, and finally a calculation was made of the resistance to oscillations or vibrations by processing the results on a computer. For the fatigue test of charge 4, samples were used that were made with rolled steel rods subjected to detensioning treatment, with a diameter of 40 mm. The results of the static mechanical test of the steel rods produced by rolling from charge 4 appear in Table 13.

TABLE 13

| Designation Unit of measure | Values corresponding to charge 4 |
|---|---|
| $R_p^{0.002}$ N/mm$^2$ | 1150 |
| $R_m$ N/mm$^2$ | 1200 |
| $A_5$ % | 14 |
| Z % | 43 |

2.31 Fatigue test by cyclic torsion forces

This test was aimed at determining the Woehler diagram for the combined bending and symmetrical oscillation force.

2.32 Degrees or stages of load of fatigue test by cyclic torsion forces

TABLE 14

| Degree of load | Bending forces (N/mm$^2$) |
|---|---|
| I. | 588 |
| II. | 539 |
| III. | 515 |
| IV. | 490 |

2.33 Parameters of fatigue test by cyclic torsion forces

TABLE 15

| $R_1$ N/mm$^2$ | $N_1$ | $\Delta R_1$ | $\Delta N$ |
|---|---|---|---|
| 294 | $7.5 \times 10^5$ | 24.5 | $10^5$ |
| 441 | $3.0 \times 10^6$ | 24.5 | $10^5$ |
| 490 | $4.6 \times 10^6$ | 24.5 | $10^5$ |
| 441 | $10^6$ | 24.5 | $10^5$ |
| 441 | $6.1 \times 10^6$ | 24.5 | $10^5$ |

$R_1$ = initial load
$N_1$ = stress cycle (number of stresses)
$\Delta R_1$ = value of the degree or stage of the load
$\Delta N$ = number of cycles 2.34 Test results

TABLE 16

| Degree or stage of load | Bending force | Life |
|---|---|---|
| I. | 588 | $1.1 \times 10^5$–$1.26 \times 10^5$ |
| II. | 539 | $1.65 \times 10^5$–$2.48 \times 10^5$ |

TABLE 16-continued

| Degree or stage of load | Bending force | Life |
|---|---|---|
| III. | 515 | $2.00 \times 10^5$–$7.00 \times 10^5$ |
| IV. | 490 | $2.7 \times 10^5$–$3.64 \times 10^6$ |

2.35 Data on the distribution of the test results of fatigue by cyclic torsion forces, after processing of these results in a computer

TABLE 17

| Degree or stage of load | 50% probable life | Dispersion square | Life of 84% | Life of 16% |
|---|---|---|---|---|
| I. | $1.15 \times 10^5$ | 1.066 | $1.23 \times 10^5$ | $1.02 \times 10^5$ |
| II. | $1.93 \times 10^5$ | 1.175 | $2.27 \times 10^5$ | $1.64 \times 10^5$ |
| III. | $3.26 \times 10^5$ | 1.508 | $4.92 \times 10^5$ | $2.17 \times 10^5$ |
| IV. | $1.06 \times 10^6$ | 3.658 | $3.89 \times 10^6$ | $2.86 \times 10^5$ |

2.36 Fatigue test by torsion force

This test was intended to determine the Woehler diagram by the combined torsion and symmetrical oscillation force.

2.37 Degrees of stage of load of fatigue test by torsion forces

TABLE 18

| Degree or stage of load | Rotation torque (joule) of fatigue test by torsion forces | Stress (N/mm$^2$) |
|---|---|---|
| I. | 27.47 | 408 |
| II. | 24.52 | 365 |
| III. | 22.56 | 335 |
| IV. | 20.60 | 306 |

2.38 Parameters of fatigue test by torsion forces

TABLE 19

Initial torque M csa-1 19.62 joule
Initial stress T a-1 = 291 N/mm$^2$
Value of degree or stage of stress or load Ta = 14.7 N/mm$^2$
Number of stresses $N_1 = 10^5$
Number of cycles $\Delta N = 10^5$ 2.39 Test results of fatigue by torsion forces

TABLE 20

| Degree or stage or | Rotation torque (Joule) | Stress (N/mm$^2$) | Life |
|---|---|---|---|
| I. | 27.47 | 408 | $0.4 \times 10^5$–$2.16 \times 10^5$ |
| II. | 24.52 | 365 | $0.8 \times 10^5$–$7.90 \times 10^5$ |
| III. | 22.56 | 335 | $1.55 \times 10^5$–$9.54 \times 10^5$ |
| IV. | 20.60 | 306 | $2.86 \times 10^5$–$1.48 \times 10^6$ |

2.4 Values of dynamic resistance to oscillations or vibrations determined on the basis of fatigue test by cyclic torsion forces

TABLE 21

| Breaking probability | Resistance to oscillations or vibrations Rvh |
|---|---|
| 16% | 373 |
| 50% | 409 |
| 84% | 441 |

2.5 Values of resistance to oscillations or vibrations determined on the basis of fatigue test by torsion forces

TABLE 22

| Breaking probability | Resistance to oscillation or vibrations Tv |
|---|---|
| 16% | 254 |
| 50% | 254 |
| 84% | 255 |

2.6 Interpretation of results

The values of resistance to oscillations or vibrations which were obtained, namely Rvh-373 to 441 N/mm$^2$ and Tv-254 N/mm$^2$, with a steel rod produced from steel according to this invention, which had not undergone hardening treatment followed by temperting and a diameter of 40 mm, agree with the values of resistance to oscillations or vibrations of known spring steels that have undergone a hardening or hardening treatment followed by temperting. It should be noted that during the tests of fatigue by cyclic torsion forces, it was possible to obtain a notable improvement of the values of resistance to oscillations or vibrations by a suitable prior load, on the order of several millions, which was produced by a stress of about 440 N/mm$^2$. The values of resistance to oscillations or vibrations of the steel according to this invention are therefore notably improved when put into a structure, as a result of ossature work, which constitutes a very useful property of steel according to this invention.

I claim:

1. Construction steel exhibiting a high fatigue strength and, up to a well defined carbon content, a good weldability, and which is resistant to corrosion by air, consisting essentially of, besides iron, 0.04 to 1.6% (by weight) of C, 0.3 to 3% (by weight) of Mn or Ni or their mixture, at a maximum 1.8% (by weight) of Si, 0.6 to 4% (by weight) of Cu, at a maximum 3% (by weight) of Mo or Co or their mixture, 0.02 to 0.4% (by weight) of Nb or V or their mixture, 0.001 to 0.006% (by weight) of B, 0.01 to 0.4% (by weight) of Zr or Be or their mixture, 0.01 to 0.2% (by weight) of Al, 0.005 to 0.2% (by weight) of N, 0.0001 to 0.005% (by weight) of Ca, and at a maximum 0.25% (by weight) of Ce or Pb or their mixture, and up to 0.1% of sulfur.

2. Construction steel according to claim 1 consisting essentially of, besides iron and certain residual elements:

| | | | |
|---|---|---|---|
| C | 0.04–0.5% | Nb | 0.01–0.15% |
| Mn | 1.5–2% | V | 0.01–0.15% |
| Si | 0.5–1% | Zr | 0.01–0.15% |
| S | 0.01–0.05% | Al | 0.02–0.2% |
| Cu | 1.2–2% | N | 0.01–0.04% |
| Ni | 1–1.5% | B | 0.0001–0.005% |
| Mo | 0.05–0.5% | Ca | 0.0001–0.005% |
| | | Pb | 0.01–0.25% |

3. Construction steel according to claim 1 consisting essentially of, besides iron and certain residual elements:

| | | | |
|---|---|---|---|
| C | 0.04–0.5% | Nb | 0.01–0.15% |
| Mn | 1.5–2% | V | 0.05–0.15% |
| Si | 0.5–1% | Zr | 0.01–0.15% |
| S | 0.01–0.05% | Be | 0.01–0.05% |
| Cu | 1.5–2% | B | 0.0001–0.006% |
| Ni | 1–1.5% | Al | 0.01–0.2% |
| Mo | 0.05–1% | Ca | 0.0001–0.005% |
| | | Pb | 0.01–0.25% |

* * * * *